US011162362B2

(12) United States Patent
Jia et al.

(10) Patent No.: US 11,162,362 B2
(45) Date of Patent: Nov. 2, 2021

(54) ANCHORING APPARATUS AND OPERATION METHOD THEREOF

(71) Applicant: HENAN POLYTECHNIC UNIVERSITY, Jiaozuo (CN)

(72) Inventors: Housheng Jia, Jiaozuo (CN); Wenbing Guo, Jiaozuo (CN); Shaowei Liu, Jiaozuo (CN); Wenyuan Jiang, Jiaozuo (CN); Zhiqiang Zhao, Jiaozuo (CN); Bo Peng, Jiaozuo (CN); Guanghui Zhi, Jiaozuo (CN); Mengjie Zhang, Jiaozuo (CN); Xuhai Ding, Jiaozuo (CN); Mengxiong Fu, Jiaozuo (CN); Yongen Li, Jiaozuo (CN); Zhiqiang Guo, Jiaozuo (CN)

(73) Assignee: HENAN POLYTECHNIC UNIVERSITY, Jiaozuo (CN)

( * ) Notice: Subject to any disclaimer, the term of this patent is extended or adjusted under 35 U.S.C. 154(b) by 0 days.

(21) Appl. No.: 17/098,402

(22) Filed: Nov. 15, 2020

(65) Prior Publication Data

US 2021/0062654 A1 Mar. 4, 2021

Related U.S. Application Data

(63) Continuation of application No. PCT/CN2019/074441, filed on Feb. 1, 2019.

(51) Int. Cl.

| | |
|---|---|
| ***E21D 20/00*** | (2006.01) |
| ***E21D 11/40*** | (2006.01) |
| ***E21D 20/02*** | (2006.01) |

(52) U.S. Cl.

CPC ..... *E21D 20/006* (2013.01); *E21D 11/40* (2013.01); *E21D 20/02* (2013.01)

(58) Field of Classification Search

CPC ..... E21D 20/006; E21D 20/02; E21D 11/40

See application file for complete search history.

(56) References Cited

U.S. PATENT DOCUMENTS 6,581,698 B1 * 6/2003 Dirks ..... E21B 19/20 175/52
6,763,898 B1 * 7/2004 Roodenburg et al. .. E21B 15/00 166/358

(Continued)

FOREIGN PATENT DOCUMENTS

CN 102654060 A 9/2012
CN 104564050 A 4/2015

(Continued)

OTHER PUBLICATIONS

International Search Report of PCT/CN2019/074441, dated Nov. 6, 2019.
Written opinion Of PCT/CN2019/074441, dated Nov. 6, 2019.

*Primary Examiner* — Tara Mayo-Pinnock

(57) ABSTRACT

The present invention discloses an anchoring apparatus and an operation method thereof. The anchoring apparatus includes: a movable framework (1); a folding-type working platform (2) that includes a working platform frame (203), a longitudinal guide (204), a transverse guide (205) and a central turntable (206), the longitudinal guide (204) being movable along the transverse guide (205), and the central turntable (206) driving the longitudinal guide (204) and the transverse guide (205) to rotate relative to the working platform frame (203); a drilling machine (3); a workpiece supply system (4); and a power control system (5) that drives the movable framework (1) to move. With the anchoring apparatus, the mechanical and automatic anchoring with anchor bolts and anchor cables can be implemented in anchoring, the labor intensity in anchoring can be greatly (Continued)

reduced, the efficiency of anchoring can be improved, and the safety in the entire process can be enhanced.

9 Claims, 6 Drawing Sheets

(56) References Cited

U.S. PATENT DOCUMENTS

| | | | | |
|---|---|---|---|---|
| 7,806,207 | B1 * | 10/2010 | Barnes et al. ..... | B62D 57/028 180/8.1 |
| 2011/0248092 | A1 | 10/2011 | Nelson | |
| 2014/0154016 | A1 | 6/2014 | Nelson | |

FOREIGN PATENT DOCUMENTS

| | | | |
|---|---|---|---|
| CN | 204921002 | U | 12/2015 |
| CN | 106869976 | A | 6/2017 |
| CN | 207110982 | U | 3/2018 |
| CN | 108104853 | A | 6/2018 |
| CN | 207813635 | U | 9/2018 |
| JP | 2010059606 | A | 3/2010 |
| JP | 2012057328 | A | 3/2012 |

* cited by examiner

ANCHORING APPARATUS AND OPERATION METHOD THEREOF

CROSS-REFERENCE TO RELATED APPLICATIONS

This application is a continuation of International Application No. PCT/CN2019/074441 with a filling date of Feb. 1, 2019, designating the United states, now pending. The content of the aforementioned applications, including any intervening amendments thereto, are incorporated herein by reference.

TECHNICAL FIELD

The present invention relates to the field of mining apparatus, and particularly relates to an anchoring apparatus and an operation method thereof.

BACKGROUND ART

Nowadays, anchoring apparatuses such as anchor bolts and anchor cables are often used for roadway (tunnel) support since anchor bolts and anchor cables can provide a large axial tensile force and have a good effect in the field of roadway (tunnel) support.

With existing solutions, anchoring can only be performed manually in most cases. Further, since an anchoring process includes many steps such as drilling holes, placing anchoring agents, and installing anchor bolts and anchor cables, the anchoring efficiency is low. Besides, an internal space of the roadway is small, a part of which is also occupied by tunneling devices, so in the actual anchoring work, the staff can only perform the anchoring operation in a small space, which not only increases the difficulty of manual anchoring, but also presents a greater danger.

Therefore, it is necessary to provide a new anchoring apparatus and a method of using the anchoring apparatus to solve the above-mentioned problems.

SUMMARY OF INVENTION

In order to implement mechanical and automatic fixing of anchor bolts and anchor cables, reduce labor intensity in anchoring, improve the efficiency of anchoring and enhance safety in the entire process, the present invention discloses an anchoring apparatus, including:

a movable framework;

a folding-type working platform that is mounted on the movable framework and is rotatable with respect to the movable framework, and that includes a working platform frame, a longitudinal guide, a transverse guide and a central turntable, the transverse guide and the longitudinal guide being arranged perpendicular to each other, the longitudinal guide being movable along the transverse guide, the central turntable being disposed between the working platform frame and the transverse guide, and the central turntable driving the transverse guide and the longitudinal guide to rotate with respect to the working platform frame;

a drilling machine that is mounted on the longitudinal guide and is movable linearly with respect to the longitudinal guide;

a workpiece supply system that is mounted on the movable framework; and a power control system that drives the movable framework to move, thereby causing the entire anchoring apparatus to move.

Preferably, the longitudinal guide and/or the transverse guide are provided in a double-layer configuration to have a bottom track and an upper track that are nested and connected, and the drilling machine is movably disposed on the upper track.

Preferably, the anchoring apparatus further includes an anchoring agent fixing pipe that can be attached to the drilling machine. An anchoring agent for anchoring is provided inside the anchoring agent fixing pipe, and a fixing support seat is provided below the anchoring agent. The drilling machine is provided with an air passage, and when the anchoring agent fixing pipe is attached to the drilling machine, the anchoring agent fixing pipe is in communication with the air passage.

Preferably, the workpiece supply system includes a workpiece storage for storing the anchoring agent fixing pipe, an anchor bolt set and an anchor-bolt plate, a handling manipulator and a workpiece plate. The handling manipulator transports various types of workpieces in the workpiece storage onto the workpiece plate. The workpiece plate attaches the various types of workpieces to the drilling machine.

Preferably, the handling manipulator includes a rod handling manipulator and an anchor-bolt plate handling manipulator, the rod handling manipulator attaches the anchoring agent fixing pipe and the anchor bolt set to the workpiece plate, and the anchor-bolt plate handling manipulator attaches the anchor-bolt plate to the anchor bolt set.

Preferably, the workpiece plate includes a position-adjustment track, a telescopic guide, and a workpiece plate surface. The position-adjustment track is disposed between the telescopic guide and the working platform frame. The workpiece plate is moved along the position-adjustment track, and the telescopic guide drives the workpiece plate surface to move. A rotary motor is provided between the workpiece plate surface and the telescopic guide, and drives the workpiece plate surface to rotate.

Preferably, a top grid paving system for dragging top grids is provided at an upper part of the movable framework, and a roadway side grid paving system for dragging side grids is provided at each side of the movable framework.

Preferably, the top grid paving system includes a pre-support support frame, a power cylinder, a lower support frame and a top guide. The top guide is disposed on the body frame, the lower support frame is moved along the top guide, and the power cylinder is disposed between the pre-support support frame and the lower support frame.

The roadway side grid paving system includes a grid support frame and a lateral guide. The lateral guide is arranged between the grid support frame and the body frame, and the grid support frame is moved along the lateral guide.

The pre-support support frame, the lower support frame and the grid support frame are load-bearing frame structures.

The present invention also provides an operation method of the anchoring apparatus according to the present invention, which includes the following steps:

a first step of positioning a tunneling machine on a lower side of the anchoring apparatus, folding the folding-type working platform to allow the tunneling machine to travel freely on the lower side of the anchoring apparatus, and retreating the tunneling machine backward after the tunneling machine tunnels forward for a certain distance in a roadway;

a second step of moving the anchoring apparatus forward by a corresponding distance, unfolding the folding-type working platform downward and paving the top grids in place, and working on an anchoring hole with the drilling machine;

a third step of attaching the anchoring agent fixing pipe to the drilling machine, and blowing the anchoring agent provided therein to a bottom of the hole using a high-pressure gas;

a fourth step of attaching the anchor bolt set and the anchor-bolt plate to the drilling machine, driving the drilling machine to move to a corresponding anchoring position by the folding-type working platform, and pre-fastening the anchor bolt set and the anchor-bolt plate to complete anchoring;

a fifth step of paving grids on the right side in place, folding the folding-type working platform on the right side upward to make a corresponding room, causing the drilling machine on the folding-type working platform on the left side to repeat the second, third and fourth steps, and completing anchoring of a left roadway sidewall in a similar manner; and a sixth step of folding folding-type working platforms on the left and right sides of the anchoring apparatus upward, moving the tunneling machine forward for further roadway tunneling, and supplementing and exchanging workpieces accordingly using the workpiece supply system for next anchoring work.

With the above technical scheme according to the present invention, mechanical and automatic anchoring with anchor bolts and anchor cables is implemented, the labor intensity in anchoring is greatly reduced, the efficiency of anchoring is improved, and the safety in the entire process is enhanced.

Other characteristics and advantages of the present invention will be described in detail in the following specific embodiment.

DESCRIPTION OF DRAWINGS

Hereinafter, the present invention will be described with reference to the accompanying drawings. The accompanying drawings illustrate the present invention together with the following embodiment, provide a further understanding of the present invention and constitute a part of the specification, but do not constitute a limitation to the present invention. In the accompanying drawings.

REFERENCE SIGN LIST

Figure 1:
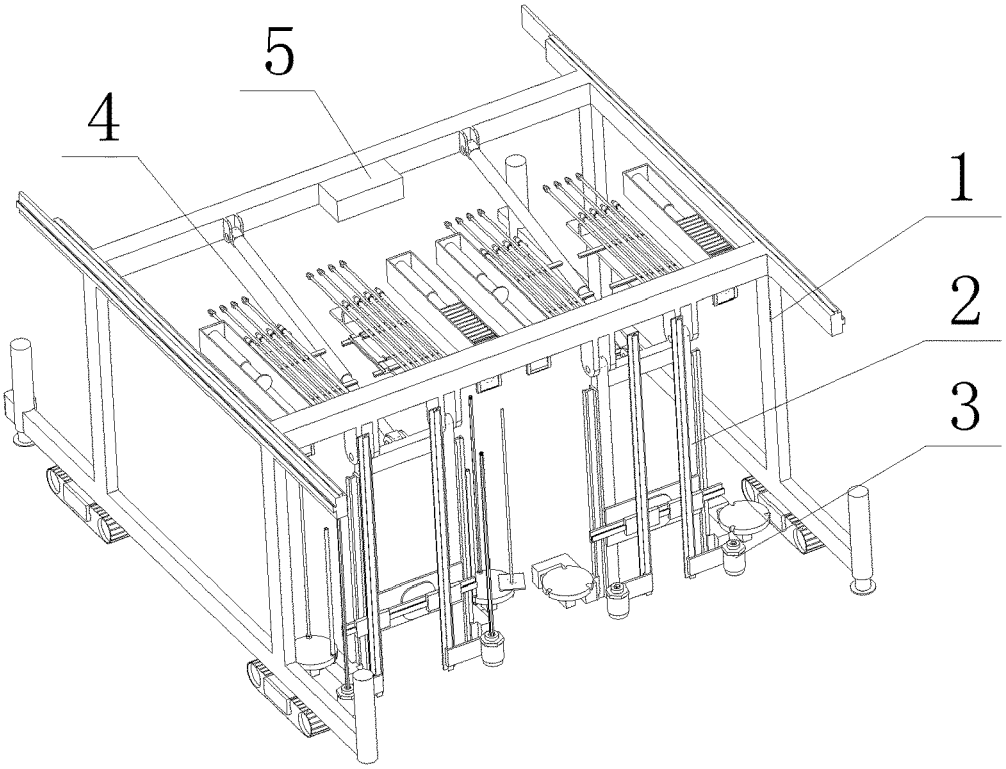
FIG. 1 is a schematic diagram illustrating an overall structural layout of an anchoring apparatus.

1 movable framework; 101 driving wheel; 102 hydraulic leg; 103 body frame; 104 top grid paving system; 104*a* pre-support support frame; 104*b* power cylinder; 104*c* lower support frame; 104*d* top guide; 105 roadway side grid paving system; 105*a* grid support frame; 105*b* lateral guide; 2 folding-type working platform; 201 lulling cylinder; 202 hinge; 203 working platform frame; 204 longitudinal guide; 205 transverse guide; 206 central turntable; 20*a* bottom track; 20*b* upper track; 3 drilling machine; 301 air passage; 302 drilling rod; 4 workpiece supply system; 40 workpiece storage; 41 handling manipulator; 411 rod handling manipulator; 412 anchor-bolt plate handling manipulator; 42 workpiece plate; 421 position-adjustment track; 422 telescopic guide; 423 workpiece plate surface; 401 anchoring agent fixing pipe; 401*a* fixing support seat; 401*b* anchoring agent; 402 anchor bolt set; 403 anchor-bolt plate; 5 power control system.

DETAILED DESCRIPTION OF EMBODIMENTS

In order to make the technical means, creative features, objectives and effects achieved by the present invention easy to understand, a specific embodiment of the present invention will be described in detail below with reference to the accompanying drawings. It should be understood that the specific embodiment described here is only used to illustrate and describe the present invention, and is not used to limit the present invention.

In the present invention, if there is no explanation to the contrary, the nouns of locality used such as "up, down, top, bottom" generally indicate directions shown in the drawings or for describing positional relationship between components mentioned above with respect to the up-down, vertical or gravity direction.

As illustrated in FIG. 1, the present invention discloses an anchoring apparatus that includes a movable framework 1, a folding-type working platform 2, a drilling machine 3, a workpiece supply system 4 and a power control system 5.

More specifically, the movable framework 1 is a gantry frame structure and can drive the entire apparatus to move. The folding-type working platform 2 is mounted on the movable framework 1, below an upper beam of the movable framework 1, and can be folded and rotated with respect to the movable framework 1. The drilling machine 3 is mounted on the folding-type working platform 2, and can be moved to different positions along the folding-type working platform 2. The workpiece supply system 4 is mounted on the movable framework 1 and can supply the drilling machine 3 with various types of workpieces required. The power control system 5 is configured to drive the movable framework 1 to move, supplies power for the anchoring apparatus, and control parts (for example, the folding-type working platform 2, the drilling machine 3 and the workpiece supply system 4) of the anchoring apparatus to perform various operations. In practical application, when a position of the drilling machine 3 is determined, anchoring work is performed with the anchoring apparatus, such as drilling a hole, loading an anchoring agent, fixing an anchor bolt and an anchor cable, and the like with respect to the position.

Figure 2:
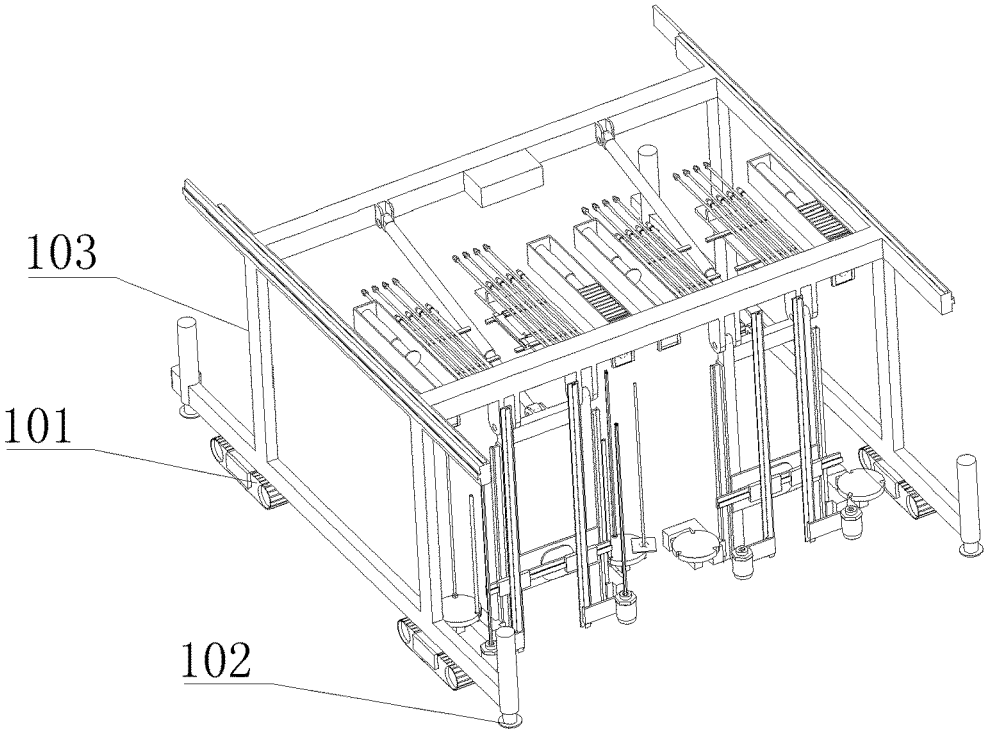
FIG. 2 is a schematic diagram illustrating a partial structure of a movable framework.

As illustrated in FIG. 2, the movable framework 1 includes driving wheels 101, hydraulic legs 102 and a body frame 103. The driving wheels 101 and the hydraulic legs 102 are disposed at a lower part of the body frame 103. The driving wheels 101 are preferably crawler-type driving wheels since crawler-type driving wheels have good adaptability to an uneven ground surface in the roadway. The hydraulic legs 102 are used to adjust a height of the movable framework 1 to ensure that the apparatus is maintained stable during anchoring work. Since the ground surface in the roadway is uneven, the entire apparatus may be inclined when supported only by the driving wheels 101. With the hydraulic legs 102 being added, the height of the apparatus can be adjusted in accordance with the position of the apparatus. As another preferred mode of the present embodiment, the driving wheels 101 and the hydraulic legs 102 can be combined as one, and the same adjusting effect can be achieved by arranging the hydraulic legs 102 between the driving wheels 101 and the body frame 103.

Figure 3:
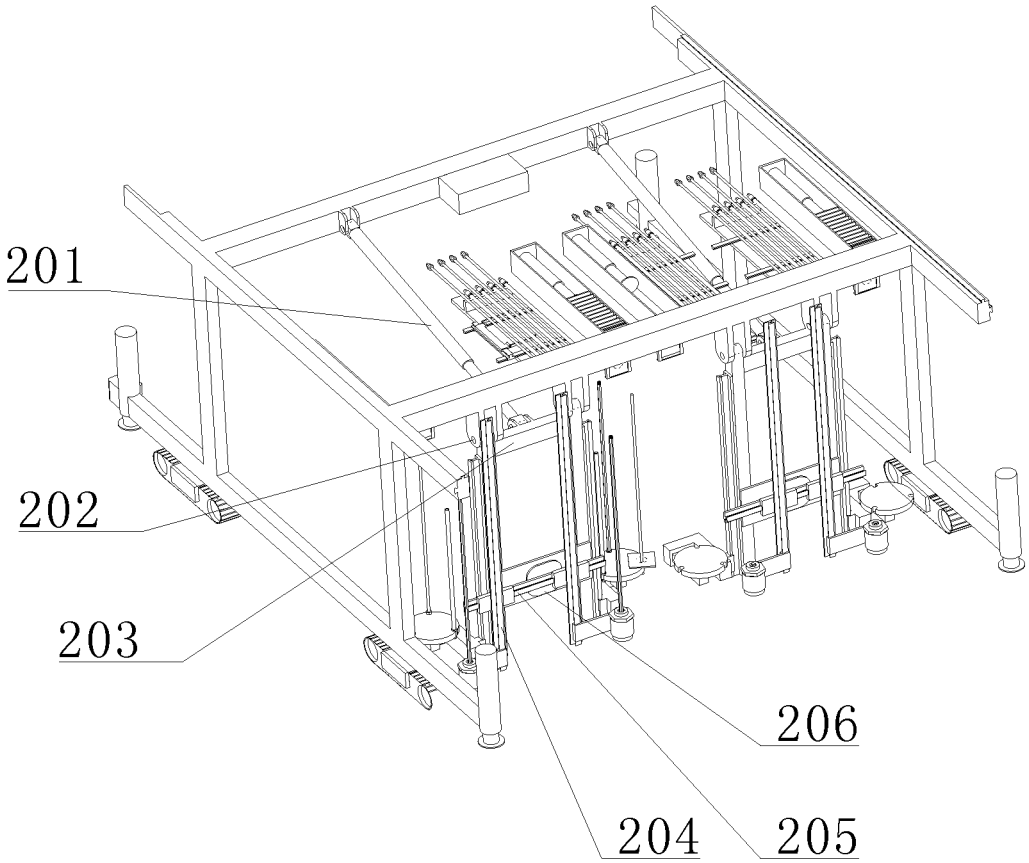
FIG. 3 is a schematic diagram illustrating a partial structure of a folding-type working platform.
Figure 4:
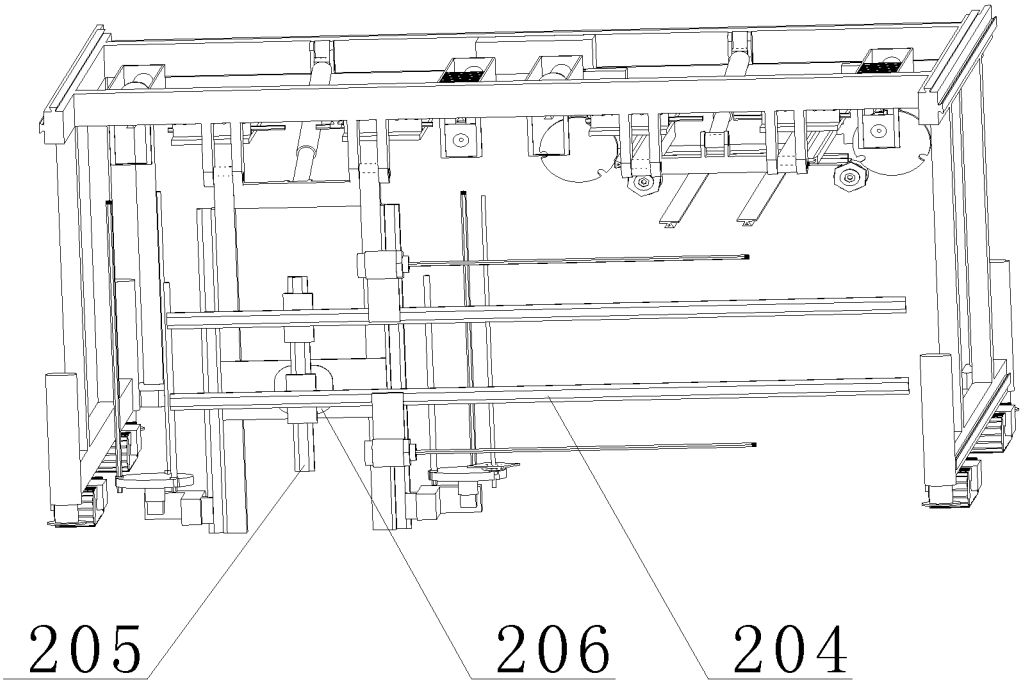
FIG. 4 is a schematic diagram illustrating a state where the anchoring apparatus is performing sidewall anchoring.

Referring to FIGS. 3 and 4, the folding-type working platform 2 is arranged below the upper beam of the movable framework 1, and includes a luffing cylinder 201, a hinge 202 and a working platform frame 203. The folding-type working platform 2 is connected to the movable framework 1 via the hinge 202. The working platform frame 203 is disposed on the folding-type working platform 2. The luffing cylinder 201 is provided between the movable framework 1 and the working platform frame 203, and can drive the folding-type working platform 2 to be turned and folded with respect to the movable framework 1 to implement folding deformation of the folding-type working platform 2. When the folding-type working platform 2 is turned upward and folded, a tunneling machine can travel freely on a lower side of the anchoring apparatus. Further, the folding-type working platform 2 is provided with a longitudinal guide 204 and a transverse guide 205. The transverse guide 205 and the longitudinal guide 204 are arranged perpendicular to each other. The longitudinal guide 204 is moved along the transverse guide 205, and can be reciprocated along the transverse guide 205. The drilling machine 3 is mounted on the longitudinal guide 204 so as to be movable along the longitudinal guide 204, and can be reciprocated linearly with respect to the longitudinal guide 204. With such an arrangement, the drilling machine 3 on the folding-type working platform 2 is allowed to move freely to different positions for working. In the present embodiment, two folding-type working platforms 2 are provided, and are provided on both sides of the movable framework 1 respectively. On each folding-type working platform 2, two longitudinal guides 204 and the drilling machine 3 are provided, thereby allowing each folding-type working platform 2 to work separately. Accordingly, the construction efficiency can be improved. A central turntable 206 is provided between the working platform frame 203 and the transverse guide 205, can drive the transverse guide 205 and the longitudinal guide 204 to rotate with respect to the working platform frame 203, and can rotate the drilling machine 3 so as to be aligned with a roadway sidewall for anchoring of the roadway sidewall. When anchoring a top wall of the roadway, the drilling machines 3 on the folding-type working platforms 2 can perform anchoring at the same time. When anchoring sidewalls of the roadway with the anchoring apparatus, one folding-type working platform 2 needs to be folded to make certain room for the other folding-type working platform 2 to rotate, so the drilling machines on the folding-type working platforms 2 on the left and right sides work alternately. That is, when the sidewall on the left side of the roadway is to be anchored, the drilling machine 3 on the folding-type working platform 2 on the left side works, and the folding-type working platform 2 on the right side is folded upward to make room accordingly. The central turntable 206 drives the transverse guide 205 and the longitudinal guide 204 to rotate, and the drilling machine 3 on the folding-type working platform 2 on the left side is caused to work on the sidewall of the roadway. When the sidewall on the right side of the roadway is to be anchored, the drilling machine 3 on the folding-type working platform 2 on the right side works and the folding-type working platform 2 on the left side is folded upward to make room accordingly. The central turntable 206 drives the transverse guide 205 and the longitudinal guide 204 to rotate, and the drilling machine 3 on the folding-type working platform 2 on the right side is caused to work on the sidewall of the roadway.

Figure 5:
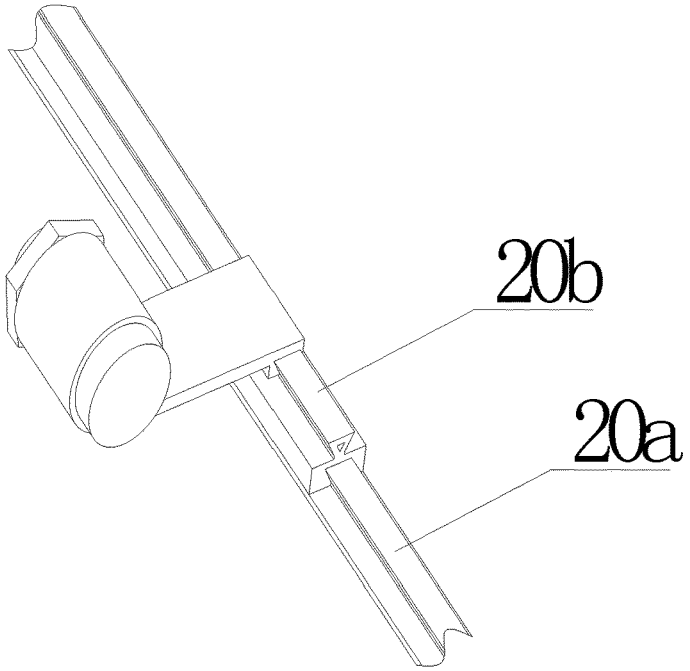
FIG. 5 is a schematic diagram illustrating a double-layer configuration of a guide.

As illustrated in FIG. 5, the longitudinal guide 204 and the transverse guide 205 are in a double-layer configuration. Each track thereof is provided with a bottom track 20*a* and an upper track 20*b*. The bottom track 20*a* and the upper track 20*b* are nested and connected and can be moved relative to each other. The drilling machine 3 is arranged on the upper track 20*b* and can be reciprocated along the upper track 20*b*. Since a height and a width of a roadway always vary, with fixed longitudinal guide 204 and transverse guide 205, a problem may occur that when anchoring the top wall and sidewalls, the anchoring apparatus may be dimensionally larger causing interference, or may be dimensionally smaller. But with the above configuration, such a problem can be solved.

Figure 6:
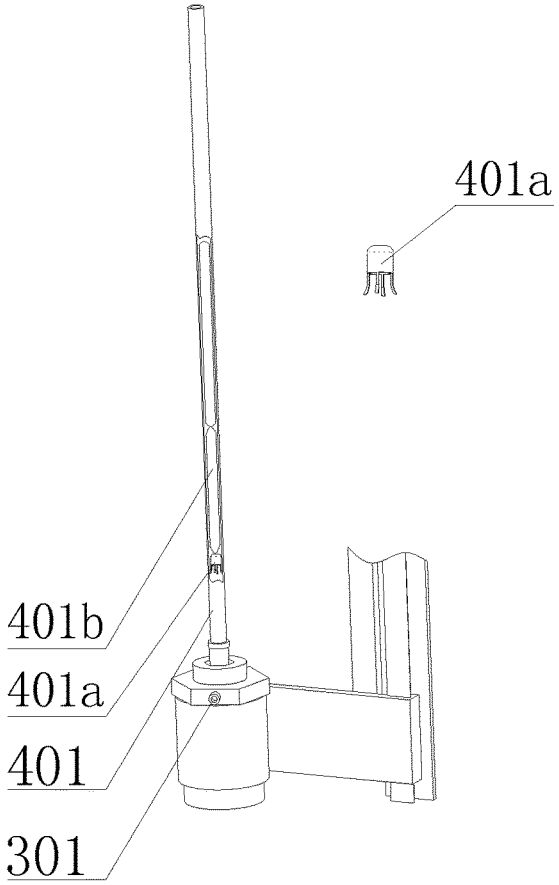
FIG. 6 is a partial sectional view of a drilling machine and an anchoring agent fixing pipe.

As illustrated in FIG. 6, the anchoring apparatus further includes an anchoring agent fixing pipe 401 that is detachably attached to the drilling machine 3. Inside the anchoring agent fixing pipe 401, an anchoring agent 401 for anchoring and a fixing support seat 401*a* are provided, the fixing support seat 401*a* being disposed at a lower end of the anchoring agent 401*b*. The drilling machine 3 is provided with an air passage 301. When the anchoring agent fixing pipe 401 is attached to the drilling machine 3, the anchoring agent fixing pipe 401 is in communication with the air passage 301. The anchoring agent fixing pipe 401 is moved via the transverse guide 205 and the longitudinal guide 204 on the folding-type working platform 2 to be aligned with an anchoring hole, and is given a high-pressure gas via the air passage 301. Then the anchoring agent 401*b* and the fixing support seat 401*a* below are blown to the bottom of the hole by the high-pressure gas. A support claw is provided at an end of the fixing support seat 401*a* for preventing the anchoring agent 401*b* from slipping out. The fixing support seat 401*a* is preferably made of a plastic material, so that at the time of anchoring with an anchor bolt, the fixing support seat 401*a* can be destroyed before the anchoring agent 401*b* is stirred for anchoring.

Figure 7:
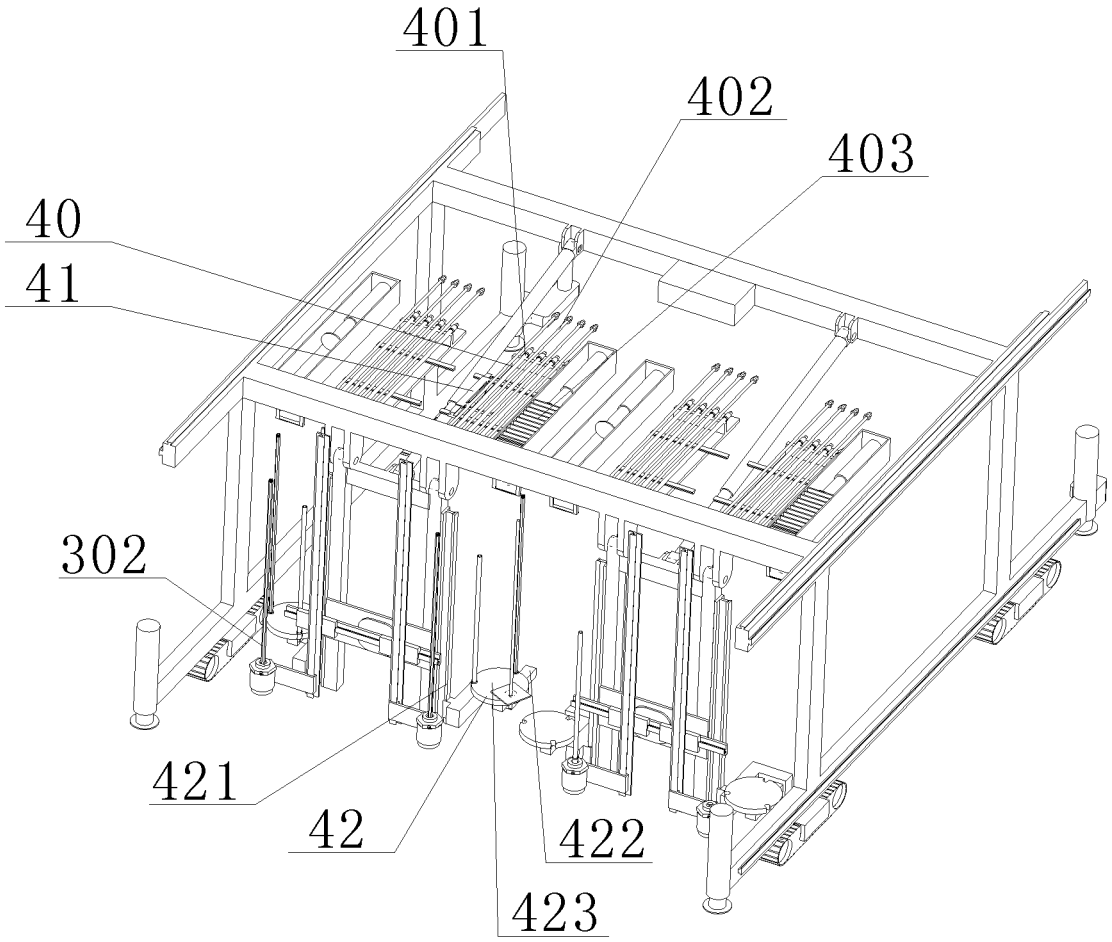
FIG. 7 is a schematic diagram illustrating a partial structure of a workpiece supply system.
Figure 8:
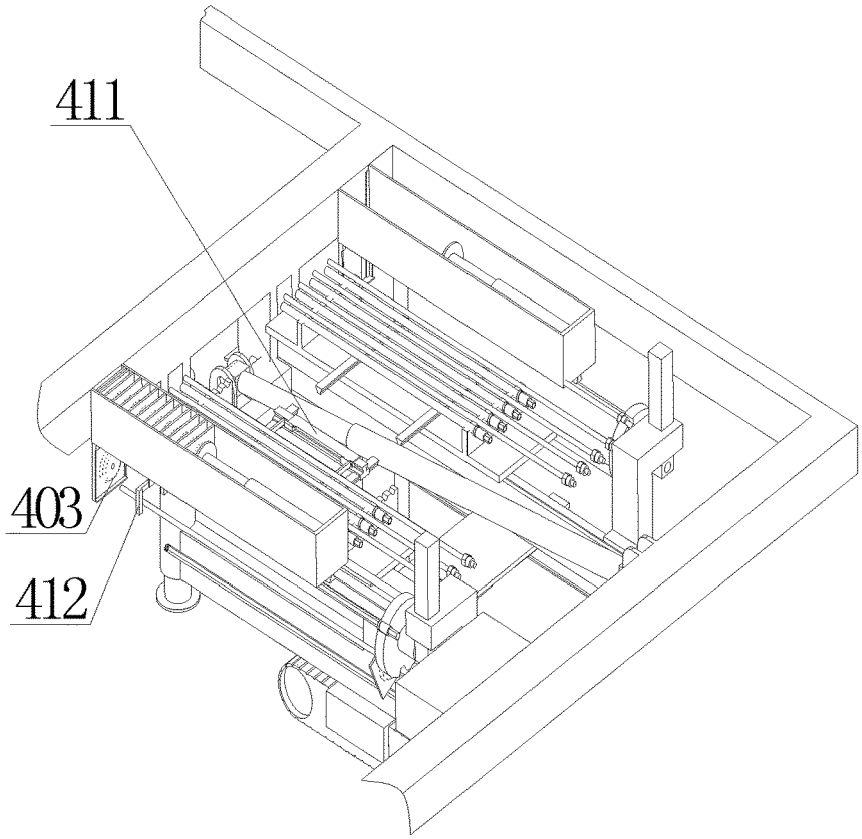
FIG. 8 is a schematic diagram illustrating a workpiece distribution state of the workpiece supply system.

Referring to FIGS. 7 and 8, the workpiece supply system 4 includes a workpiece storage 40, a handling manipulator 41 and a workpiece plate 42. The workpiece storage 40 is configured to store the anchoring agent fixing pipe 401, an anchor bolt set 402 and an anchor-bolt plate 403. The handling manipulator 41 can transport various types of workpieces in the workpiece storage 40 onto the workpiece plate 42, and the workpiece plate 42 attaches the various types of workpieces to the drilling machine 3 as required. The handling manipulator 41 includes a rod handling manipulator 411 and an anchor-bolt plate handling manipulator 412. The rod handling manipulator 411 can attach the anchoring agent fixing pipe 401 and the anchor bolt set 402 to a corresponding position of the workpiece plate 42. The anchor-bolt plate handling manipulator 412 can fix the anchor-bolt plate 403 to the anchor bolt set 402. A position-adjustment track 421 is provided between the workpiece plate 42 and the body frame 103. The workpiece plate 42 is moved along the position-adjustment track 42. The position-adjustment track 421 can adjust a position of the workpiece plate 42. The workpiece plate is provided with a telescopic guide 422 and a workpiece plate surface 423. The telescopic guide 422 can drive the workpiece plate surface 423 to move. A rotary motor is provided between the workpiece plate surface 423 and the telescopic guide 422 and can drive the workpiece plate surface 423 to rotate, and in collaboration with extension and telescoping of the telescopic guide 422 and a reciprocating motor of the position-adjustment guide 421, the various types of workpieces temporarily placed on the workpiece plate surface 423 are fixed to the drilling machine 3 accordingly. When a drilling rod 302 on the drilling machine 3 finishes drilling a hole for an anchor bolt at a corresponding position, the drilling rod 302 can be taken off and stored on the workpiece plate 42, and thereafter the anchoring agent fixing pipe 401 is attached to the drilling machine 3. When the drilling machine 3 fits the anchoring agent 401*b* inside the anchoring agent fixing pipe 401 into the hole, the anchoring agent fixing pipe 401 is taken off and stored on the workpiece plate 42. Next, the anchor bolt set 402 and the anchor-bolt plate 403 are attached to the drilling machine 3 and the drilling machine 3 fits the anchor bolt set 402 and the anchor-bolt plate 403 into the anchor bolt hole. During the fitting process, the anchoring agent 401 is stirred. Eventually, the anchoring work is completed. As can be seen from FIG. 8, conveyance of the workpieces between the workpiece storage 40 and the workpiece plate 42 is performed after the folding-type working platform 2 is folded. The anchoring agent fixing pipe 401 after use can be put back to the workpiece storage 40 for reuse. Alternatively, the workpiece supply system 4 can be fixed onto the movable framework 1 or the folding-type working platform 2, which can be set appropriately according to specific work needs.

Figure 9:
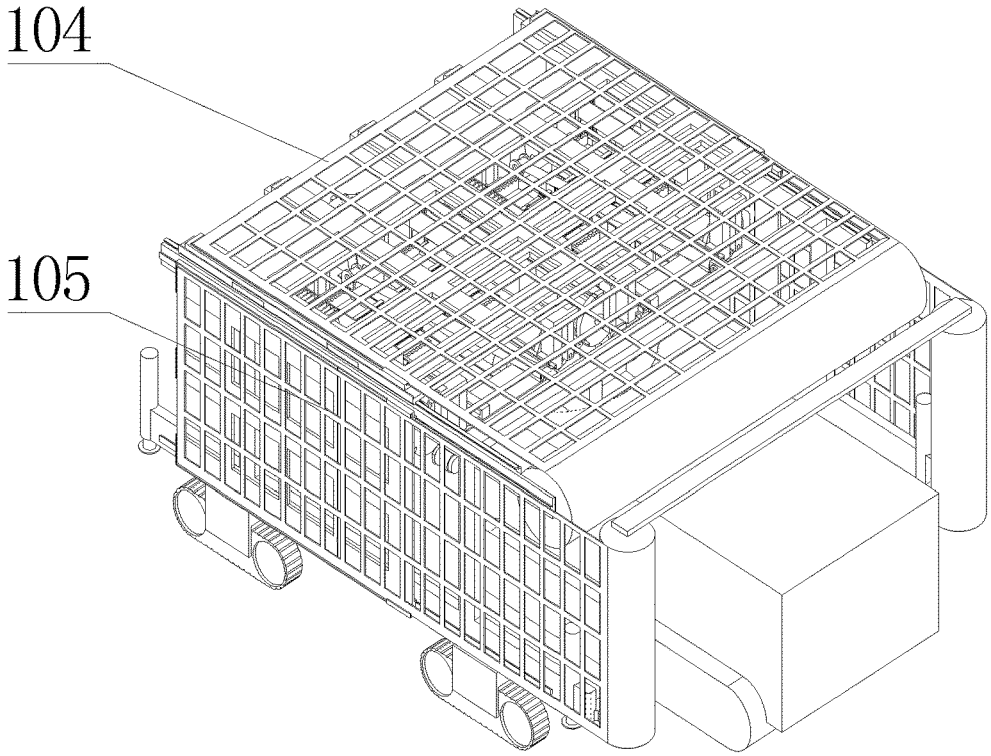
FIG. 9 is a partial rear-side perspective view of a grid paving system.
Figure 10:
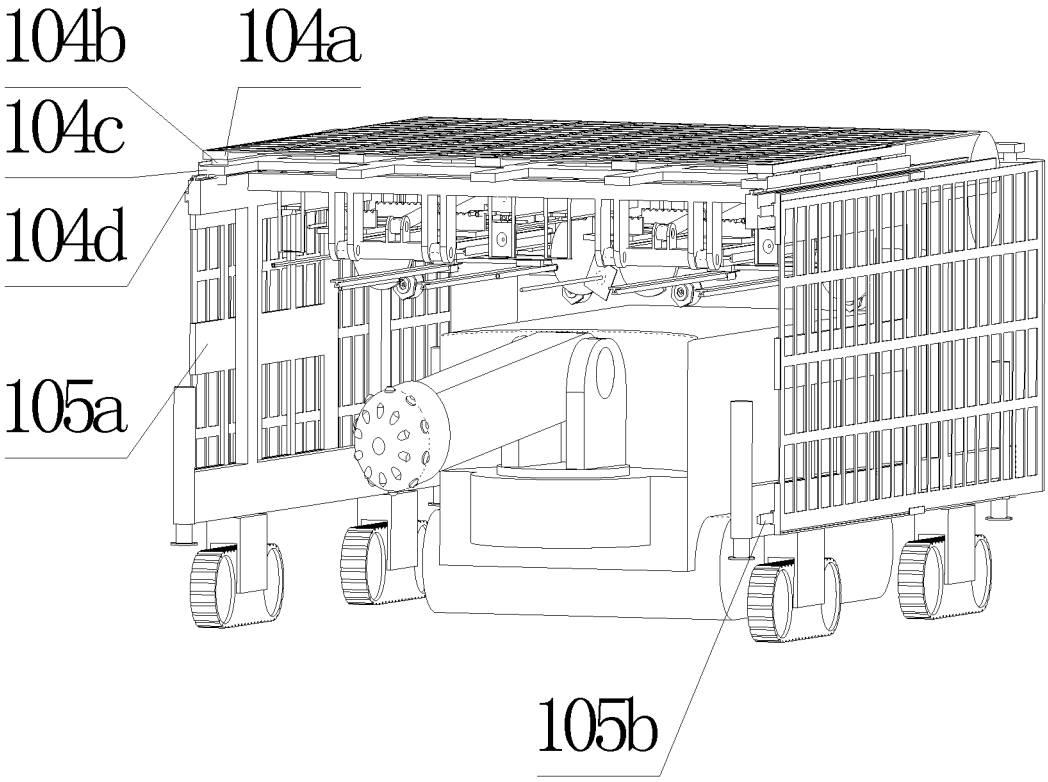
FIG. 10 is a partial front-side perspective view of the grid paving system.

Referring to FIGS. 9 and 10, the movable framework 1 is provided with a top grid paving system 104 and a roadway side grid paving system 105. The top grid paving system 104 is provided at an upper part of the movable framework 1, and the roadway side grid paving system 105 is provided on both sides of the movable framework 1. The top grid paving system 104 can pave grids over a roof when performing roof anchoring, and the roadway side grid paving system 105 can pave grids on sidewalls when performing roadway sidewall anchoring, and the grids are arranged between the anchor-bolt plate 403 and the roof. By adding the grids, falling of rubbles from a top wall and sidewalls of the roadway can be effectively prevented. The top grid paving system 104 includes a pre-support support frame 104*a*, a power cylinder 104*b*, a lower support frame 104*c* and a top guide 104*d*. The top guide 104*d* is disposed on the body frame 103, and the lower support frame 104*c* is movable along the top guide 104*d*. The power cylinder 104*b* is disposed between the pre-support support frame 104*a* and the lower support frame 104*c*. The pre-support support frame 104*a* can fix and drag the top grids, and the power cylinder 104*b* can support the pre-support support frame 104*a*. The scope of protection claimed by the present invention is defined by the appended claims and equivalents thereof.

The pre-support support frame 104*a* and the grids arranged thereon can be pressed against the roof of the roadway, thereby presenting an effect of supporting the roof when performing anchoring and drilling. The roadway side paving system 105 includes a grid support frame 105*a* and a lateral guide 105*b*. The lateral guide 105*b* is arranged between the grid support frame 105*a* and the body frame 103. The grid support frame 105*a* can be moved along the lateral guide 105*b*, and can fix and drag lateral grids. The pre-support support frame 104*a*, the lower support frame 104*c* and the grid support frame 105*a* are frame structures that can perform support.

The motive power supplied by the power control system 5 is derived from a power source. Electricity is converted into a hydraulic pressure and a gas pressure or directly drives various working parts to work, and a controller controls each part to perform corresponding operations according to the anchoring work needs. Since the motive power and control are simple arrangements in the related art according to specific needs, descriptions thereof are omitted here.

With reference to the above drawings, an operation method of the anchoring apparatus includes the following steps:

a first step of positioning a tunneling machine on a lower side of the anchoring apparatus, folding the folding-type working platform 2 to allow the tunneling machine to travel freely on the lower side of the anchoring apparatus, and retreating the tunneling machine backward after the tunneling machine tunnels forward for a certain distance in a roadway;

a second step of moving the anchoring apparatus forward by a corresponding distance, unfolding the folding-type working platform 2 downward and paving the top grids in place, moving the drilling machine 3 to a position for anchoring after the drilling rod 302 is attached thereto, and moving the drilling machine 3 upward along the longitudinal guide 204 while driving the drilling rod 302 to rotate so as to obtain an anchoring hole;

a third step of moving the drilling machine 3 downward to get the drilling rod 302 out, taking off the drilling rod 302 via the workpiece plate 42, attaching the anchoring agent fixing pipe 401 to the drilling machine 3 and moving the drilling machine 3 to a corresponding position, aligning the anchoring agent fixing pipe 401 with the anchoring hole and inserting the anchoring agent fixing pipe 401 therein by a certain distance, opening the air passage 301, and blowing the anchoring agent 401*b* to a bottom of the hole with a high-pressure gas;

a fourth step of moving the drilling machine 3 downward to get the anchoring agent fixing pipe 401 out of the hole, taking off the anchoring agent fixing pipe 401 via the workpiece plate 42, attaching the anchor bolt set 402 and the anchor-bolt plate 403 to the drilling machine 3, moving the drilling machine 3 to a corresponding anchoring position, moving the drilling machine 3 upward along the longitudinal guide 204 while driving the anchor bolt set 402 to rotate to stir the anchoring agent in the anchoring hole, and pre-fastening the anchor bolt set 402 and the anchor-bolt plate 403 to complete anchoring;

a fifth step of paving grids on the right side in place, folding the folding-type working platform 2 on the right side upward to make a corresponding room, attaching the drilling rod 302 to the drilling machine 3 on the folding-type working platform 2 on the left side, driving the drilling machine 3 by the central turntable 206 to rotate rightward with the longitudinal guide 204, making the drilling rod 302 align with the roadway sidewall on the right side and drilling an anchoring hole at a position where anchoring is needed, then repeating the attaching of the anchoring agent 401*b* in the third step and attaching of the anchor bolt set 402 and the anchor-bolt plate 403 in the fourth step to complete anchoring on the right side, and further completing anchoring of a left roadway sidewall in a similar manner; and a sixth step of turning and folding the folding-type working platforms 2, moving the tunneling machine forward for further roadway tunneling, and supplementing and exchanging workpieces accordingly between the workpiece plate 42 and the workpiece storage 40 using the handling manipulator 41 for next anchoring work.

With the above technical scheme according to the present invention, mechanical and automatic anchoring with anchor bolts and anchor cables is implemented, the labor intensity in anchoring is greatly reduced, the efficiency of anchoring is improved, and the safety in the entire process is enhanced.

Those skilled in the art should understand that the present invention is not limited by the above-mentioned embodiment. The above-mentioned embodiment and the specification only illustrate the principles of the present invention. Without departing from the spirit and scope of the present invention, the present invention will have various aspects. Variations and improvements, these changes and improvements fall within the scope of the claimed invention.

What is claimed is:

1. An anchoring apparatus, comprising:

a movable framework (1);

a folding-type working platform (2) that is mounted on the movable framework (1) and is rotatable with respect to the movable framework (1), and that includes a working platform frame (203), a longitudinal guide (204), a transverse guide (205) and a central turntable (206), the transverse guide (205) and the longitudinal guide (204) being arranged perpendicular to each other, the longitudinal guide (204) being movable along the transverse guide (205), the central turntable (206) being disposed between the working platform frame (203) and the transverse guide (205), and the central turntable (206) driving the transverse guide (205) and the longitudinal guide (204) to rotate with respect to the working platform frame (203);

a drilling machine (3) that is mounted on the longitudinal guide (204) and is movable linearly with respect to the longitudinal guide (204);

a workpiece supply system (4) that is mounted on the movable framework (1); and a power control system (5) that drives the movable framework (1) to move, thereby causing the entire anchoring apparatus to move.

2. The anchoring apparatus according to claim 1, wherein the longitudinal guide (204) and/or the transverse guide (205) are provided in a double-layer configuration to have a bottom track (20*a*) and an upper track (20*b*) that are nested and connected, and the drilling machine (3) is movably disposed on the upper track (20*b*).

3. The anchoring apparatus according to claim 1, further comprising:

an anchoring agent fixing pipe (401) that is attachable to the drilling machine (3), wherein an anchoring agent (401*b*) for anchoring is provided inside the anchoring agent fixing pipe (401), and a fixing support seat (401*a*) is provided below the anchoring agent (401*b*); the drilling machine (3) is provided with an air passage (301), and when the anchoring agent fixing pipe (401) is attached to the drilling machine (3), the anchoring agent fixing pipe (401) is in communication with the air passage (301).

4. The anchoring apparatus according to claim 3, wherein the workpiece supply system (4) includes a workpiece storage (40) for storing the anchoring agent fixing pipe (401), an anchor bolt set (402) and an anchor-bolt plate (403), a handling manipulator (41) and a workpiece plate (42), the handling manipulator (41) transports various types of workpieces in the workpiece storage (40) onto the workpiece plate (42), and the workpiece plate (42) attaches the various types of workpieces to the drilling machine (3).

5. The anchoring apparatus according to claim 4, wherein the handling manipulator (41) includes a rod handling manipulator (411) and an anchor-bolt plate handling manipulator (412), the rod handling manipulator (411) attaches the anchoring agent fixing pipe (401) and the anchor bolt set (402) to the workpiece plate (42), and the anchor-bolt plate handling manipulator (412) attaches the anchor-bolt plate (403) to the anchor bolt set (402).

6. The anchoring apparatus according to claim 4, wherein the workpiece plate (42) includes a position-adjustment track (421), a telescopic guide (422), and a workpiece plate surface (423), the position-adjustment track (421) is disposed between the telescopic guide (422) and the working platform frame (203), the workpiece plate (42) is moved along the position-adjustment track (421), and the telescopic guide (422) drives the workpiece plate surface (423) to move, and a rotary motor is provided between the workpiece plate surface (423) and the telescopic guide (422), and drives the workpiece plate surface (423) to rotate.

7. The anchoring apparatus according to claim 1, wherein a top grid paving system (104) for dragging top grids is provided at an upper part of the movable framework (1), and a roadway side grid paving system (105) for dragging side grids is provided at each side of the movable framework (1).

8. The anchoring apparatus according to claim 7, wherein the top grid paving system (104) includes a pre-support support frame (104*a*), a power cylinder (104*b*), a lower support frame (104*c*) and a top guide (104*d*), the top guide (104*d*) is disposed on the body frame (103), the lower support frame (104*c*) is moved along the top guide (104*d*), and the power cylinder (104*b*) is disposed between the pre-support support frame (104*a*) and the lower support frame (104*c*);

the roadway side grid paving system (105) includes a grid support frame (105*a*) and a lateral guide (105*b*), the lateral guide (105*b*) is arranged between the grid support frame (105*a*) and the body frame (103), and the grid support frame (105*a*) is moved along the lateral guide (105*b*); and the pre-support support frame (104*a*), the lower support frame (104*c*) and the grid support frame (105*a*) are load-bearing frame structures.

9. An operation method of the anchoring apparatus according to claim 1, comprising:

a first step of positioning a tunneling machine on a lower side of the anchoring apparatus, folding the folding-type working platform (2) to allow the tunneling machine to travel freely on the lower side of the anchoring apparatus, and retreating the tunneling machine backward after the tunneling machine tunnels forward for a certain distance in a roadway;

a second step of moving the anchoring apparatus forward by a corresponding distance, unfolding the folding-type working platform (2) downward and paving the top grids in place, and working on an anchoring hole with the drilling machine (3);

a third step of attaching the anchoring agent fixing pipe (401) to the drilling machine (3), and blowing the anchoring agent (401*b*) provided therein to a bottom of the hole using a high-pressure gas;

a fourth step of attaching the anchor bolt set (402) and the anchor-bolt plate (403) to the drilling machine (3), driving the drilling machine (3) to move to a corresponding anchoring position by the folding-type working platform (2), and pre-fastening the anchor bolt set (402) and the anchor-bolt plate (403) to complete anchoring;

a fifth step of paving grids on the right side in place, folding the folding-type working platform (2) on the right side upward to make a corresponding room, causing the drilling machine (3) on the folding-type working platform (2) on the left side to repeat the second, third and fourth steps, and completing anchoring of a left roadway sidewall in a similar manner; and a sixth step of folding the folding-type working platforms (2) on the left and right sides of the anchoring apparatus upward, moving the tunneling machine forward for further roadway tunneling, and supplementing and exchanging workpieces accordingly using the workpiece supply system (4) for next anchoring work.

* * * * *